US005615428A

United States Patent [19]

Li

[11] Patent Number: 5,615,428

[45] Date of Patent: Apr. 1, 1997

[54] ELASTIC CRADLE

[76] Inventor: Hsing Li, 17, Yung Hsing Street, Taichung, Taiwan

[21] Appl. No.: 667,597

[22] Filed: Jun. 24, 1996

[51] Int. Cl.[6] ..... A47D 9/02

[52] U.S. Cl. ..... 5/109; 5/104

[58] Field of Search ..... 5/101, 104, 108, 5/109

[56] References Cited

U.S. PATENT DOCUMENTS

| | | | |
|---|---|---|---|
| 1,420,582 | 6/1922 | Shea | 5/109 |
| 1,449,301 | 3/1923 | Shea | 5/109 |
| 3,022,520 | 2/1962 | Finger | 5/109 |
| 3,653,080 | 4/1972 | Hafele | 5/108 |
| 4,141,095 | 2/1979 | Adachi | 5/108 |
| 5,342,113 | 8/1994 | Wu | 5/109 X |

*Primary Examiner*—Michael F. Trettel

*Attorney, Agent, or Firm*—Beveridge, DeGrandi, Weilacher & Young LLP

[57] ABSTRACT

A cradle comprises a support frame and a base. The support frame is intended to hold an infant and is provided at one end thereof with a retaining hook. The base is provided with a plurality of castors fastened pivotally therewith and is further provided with an actuating, box comprising an elastic cord which is provided at the top thereof with a plurality of engaging rings engageable with the retaining hook of the support frame. The actuating box is provided therein with a motor, a disk with a cam fastened therewith, and a swing arm provided with an eccentric wheel having a groove engageable with the bottom end of the elastic cord. The swing arm is further provided with a rotor engageable with the cam. The eccentric wheel is actuated by the cam which is in turn actuated by the motor. The elastic cord is pulled downwards by the eccentric wheel in motion so as to cause the cradle to swing downwards. The flexible mechanism located at the front end of the cradle is capable of causing the cradle to swing upwards when the elastic cord is relieved of the downward pulling force.

6 Claims, 4 Drawing Sheets

ELASTIC CRADLE

FIELD OF THE INVENTION

The present invention relates generally to a cradle, and more particularly to an elastic cradle free from safety hazards.

BACKGROUND OF THE INVENTION

As shown in FIGS. 1 and 2, a prior art cradle B is composed of a support frame A and a base C. The support frame A is fastened at the front end threrof with the base C by means of a flexible means D such that the cradle B can be caused to move up and down in a reciprocating manner. The support frame A is provided at the rear end A1 thereof with a fastening rod E which is in turn provided with a permanent magnet E. The base c is provided at the rear end thereof with an iron core F which is fitted into a coil and is provided on the back thereof with a planar seat F1. The permanent magnet E is coplanar with the iron core F such that the permanent magnet E can be so adjusted as to locate at the same level as the iron core F. When the permanent magnet E is moved up and down, the circuit control coil of the iron core F brings about the repulsive magnetic field to keep the cradle B moving up and down. In other words, the cradle B is kept in the normal operating state only when the permanent magnet E and the iron core F at located at the same level. However, such an equilevel state of the permanent magnet E and the iron core F as described above can be upset easily by a change in the weight of an infant. As shown in FIG. 2, the prior art cradle B is provided with an outer tube E2 which is located over the fastening rod E1 for correcting the level at which the permanent magnet E is located. As the infant grows up rapidly, the level of the permanent magnet E must be adjusted from time to time so as to keep the cradle B operating normally. In addition, the repulsive magnetic field brought about by the magnet E and the iron core F is vulnerable to destruction at such time when the cradle B happens to be near a magnetic object having a magnetic field greater than the magnetic field of the cradle B. Moreover, the prior art cradle B can be caused to fail to operate by an iron block which is accidentally or playfully misplaced between the permanent magnet E and the iron core F.

SUMMARY OF THE INVENTION

It is therefore the primary objective of the present invention to provide an improved cradle devoid of the shortcomings of the prior art cradle described above.

In keeping with the principle of the present invention, the foregoing objective of the present invention is attained by an elastic cradle, which comprises a support frame and a base. The support frame is provided at one end thereof with a hook while the base is provided at one end thereof with an actuating box comprising an elastic cord which is provided at the top end thereof with a plurality of engaging rings engageable with the hook of the support frame. The actuating box is provided therein with a motor, a cam, and an eccentric wheel connected with the elastic cord. The eccentric wheel is actuated by the cam which is in turn actuated by the motor. The elastic cord is actuated to move downwards by the eccentric wheel in motion so as to cause the cradle to swing downwards. In the meantime, the flexible mechanism located at the front end of the cradle is capable of causing the cradle to swing upwards. The transmission elements are all enclosed safely in the actuating box.

The foregoing objective, features, functions, and advantages of the present invention will be more readily understood upon a thoughtful deliberation of the following detailed description of a preferred embodiment of the present invention in conjunction with the accompanying drawings.

DETAILED DESCRIPTION OF THE EMBODIMENT

Figure 1:
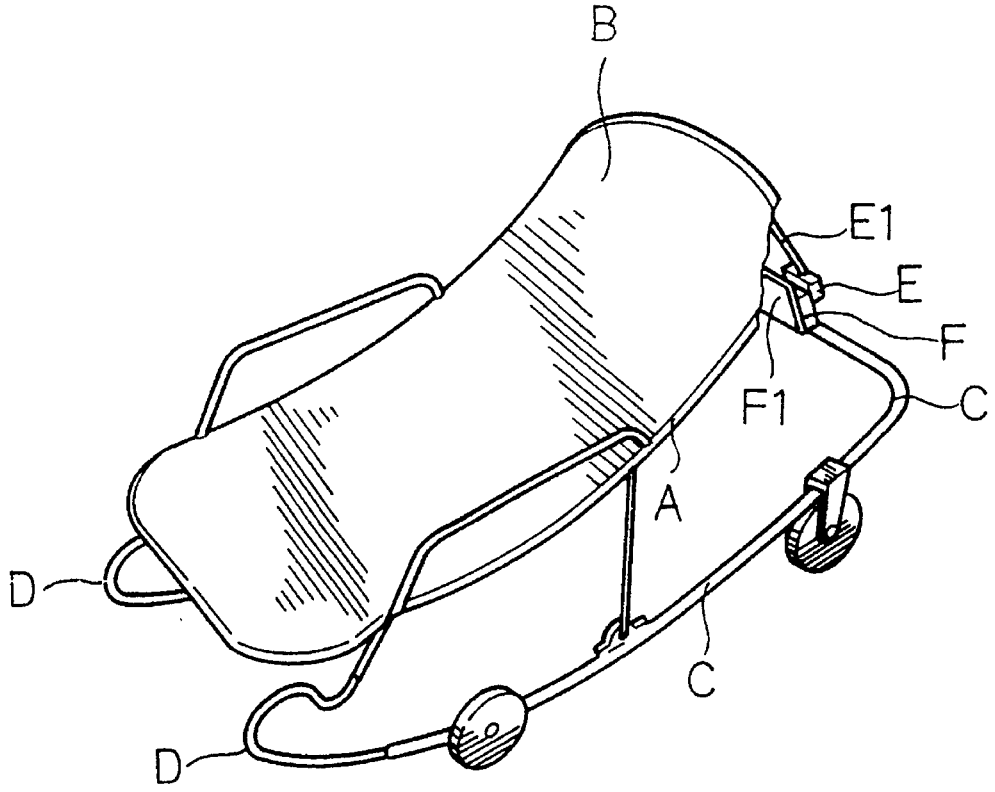
PRIOR ART FIG. 1
FIG 1 shows a perspective view of a cradle of the prior art.
Figure 2:
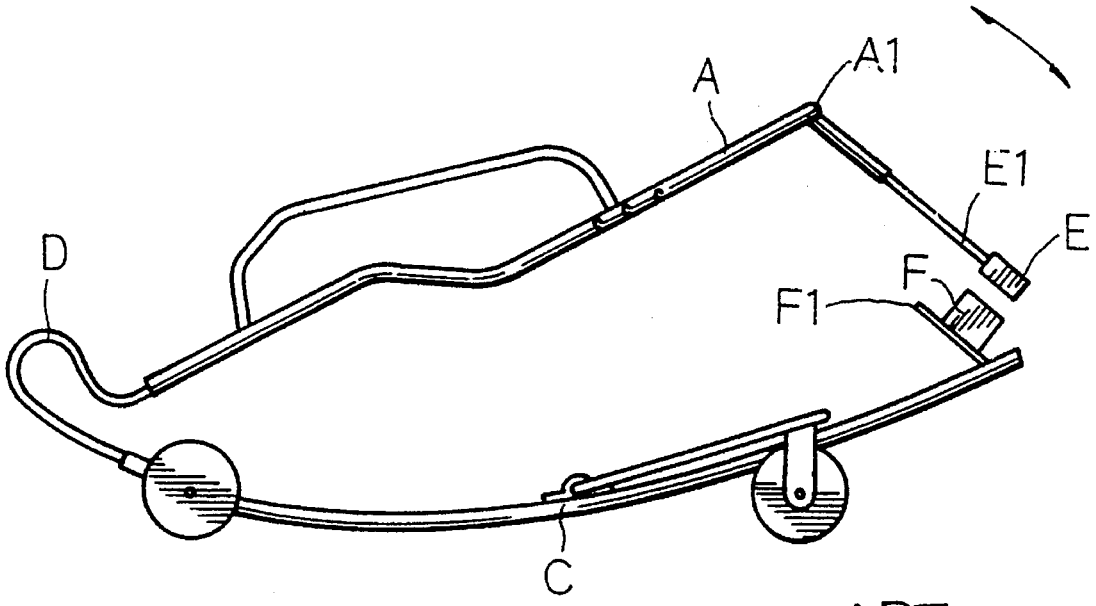
PRIOR ART FIG. 2
FIG. 2 shows a side schematic view of the prior art cradle as shown in FIG. 1.
Figure 3:
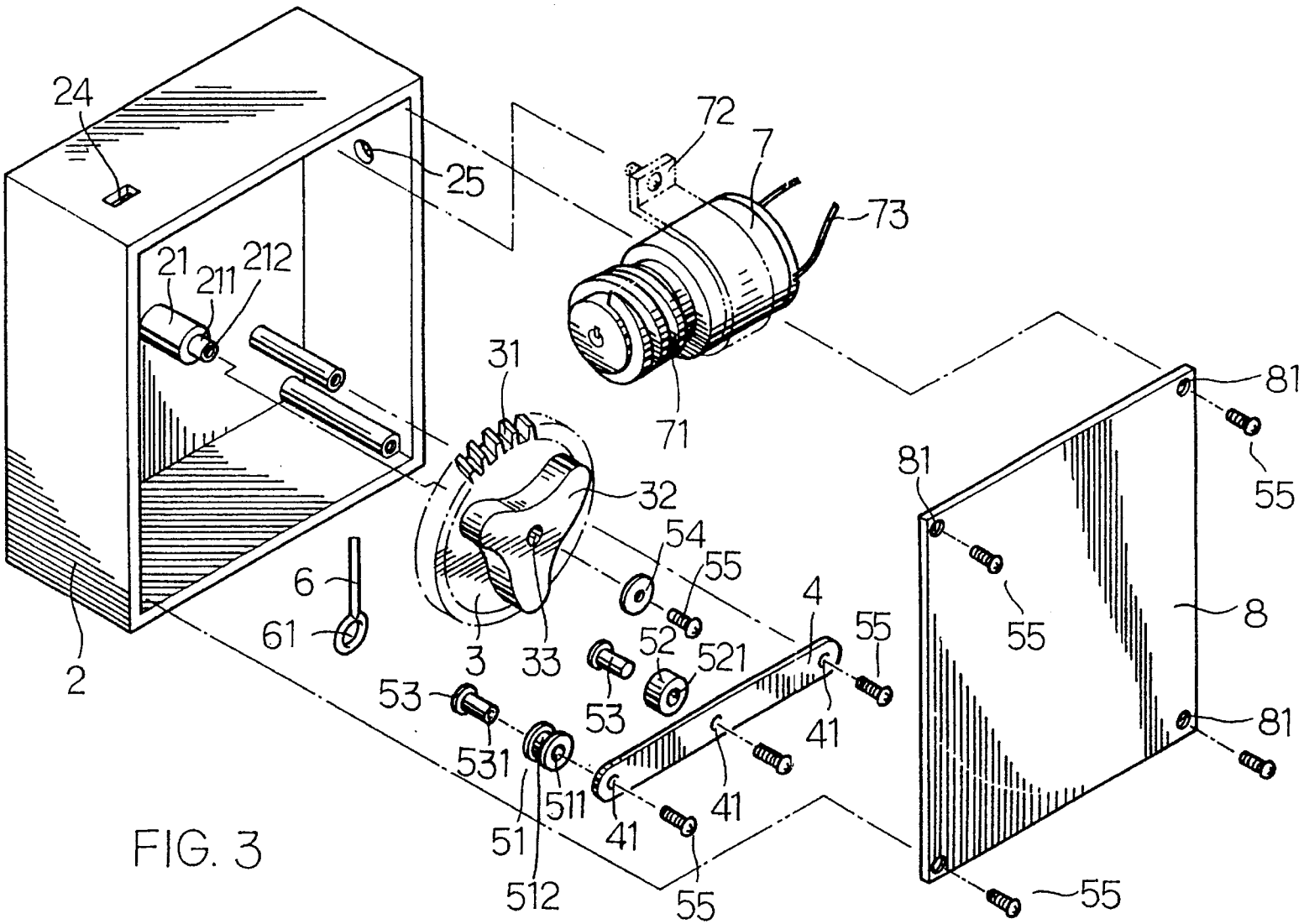
FIG. 3 shows an exploded view of a cradle of the present invention.
Figure 4:
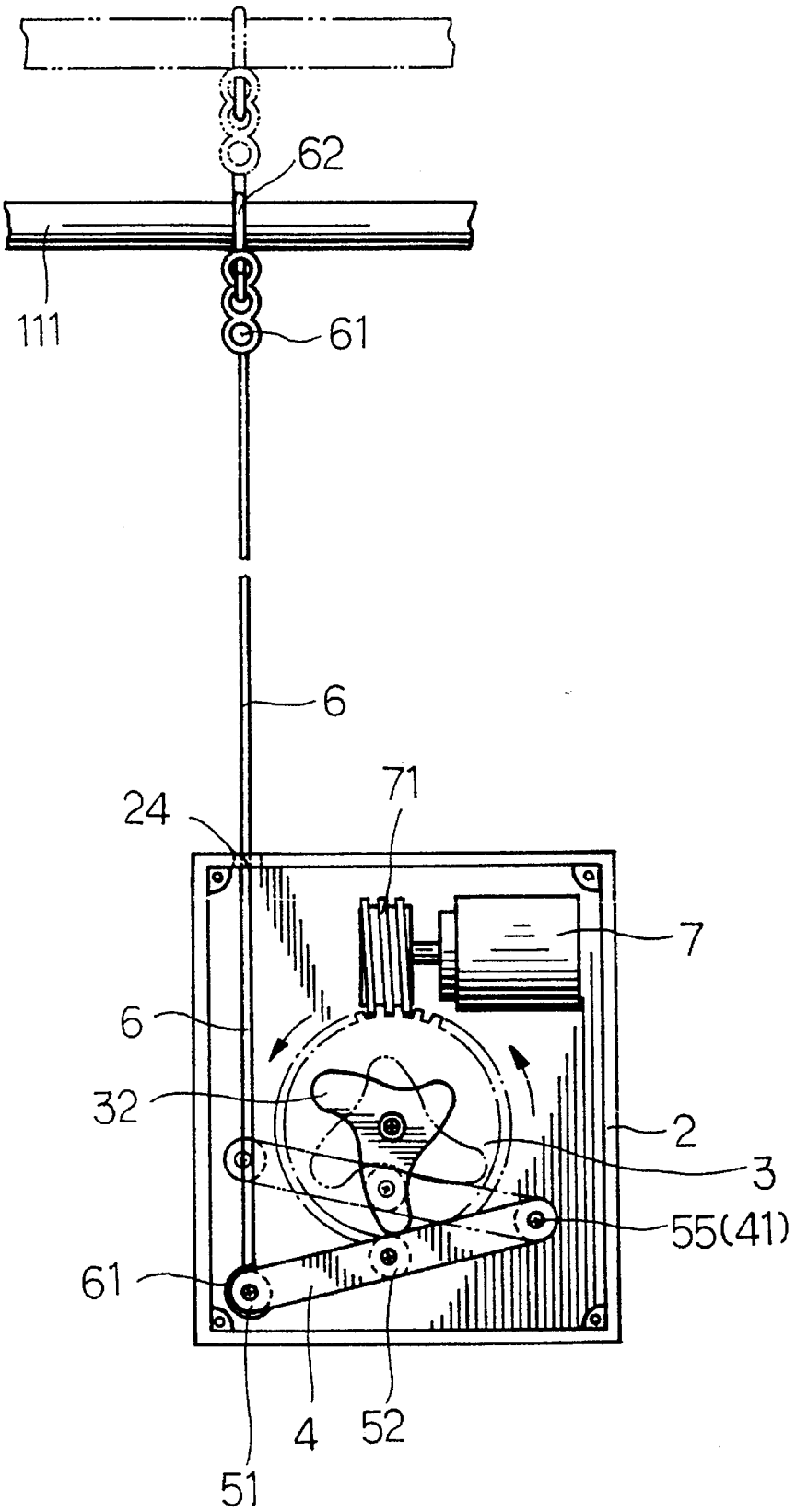
FIG. 4 shows a schematic view of the cradle at work according to the present invention.
Figure 5:
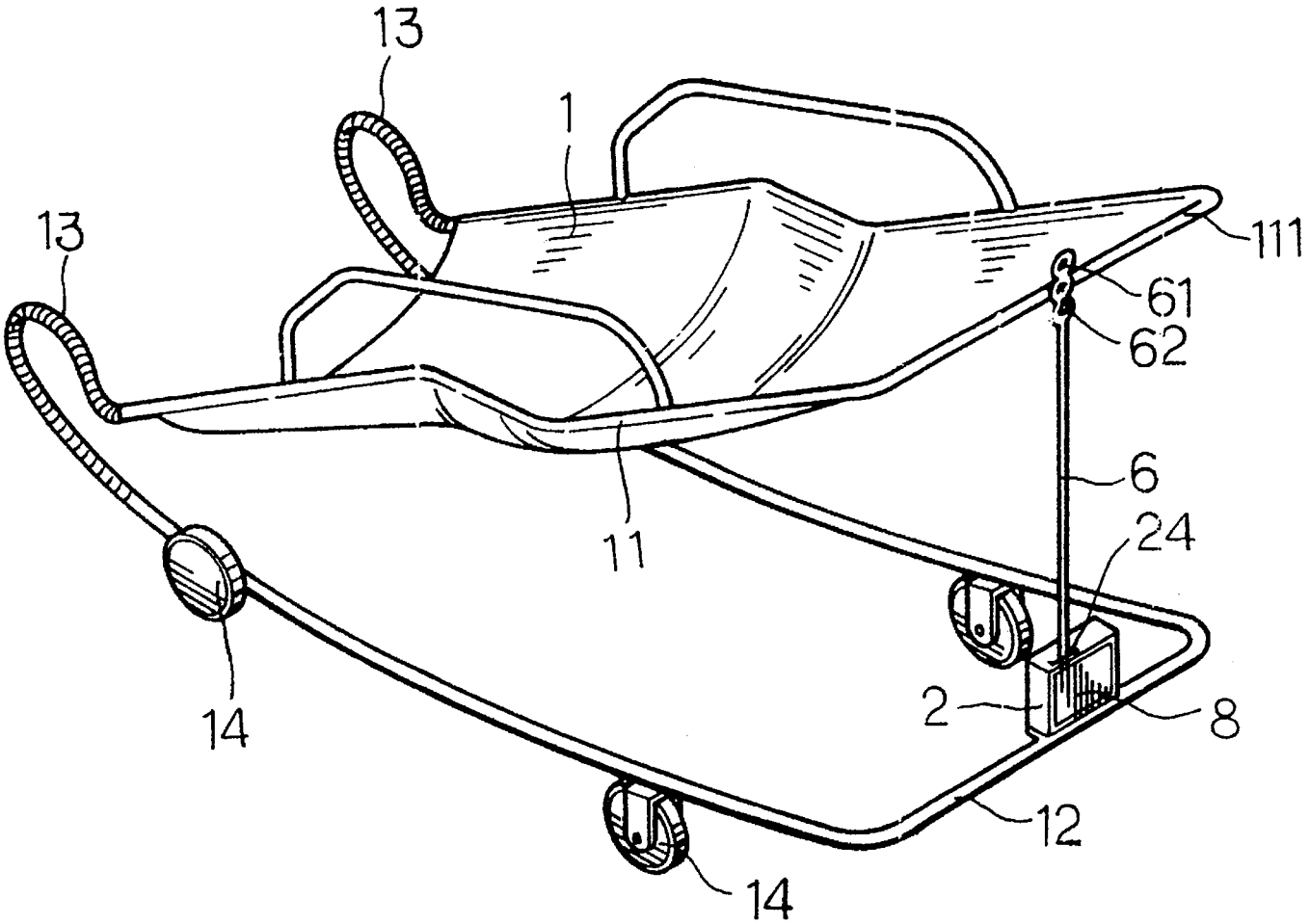
FIG. 5 shows a perspective view of the cradle in combination according to the preferred embodiment of the present invention.

As shown in FIGS. 3–5, a cradle 1 embodied in the present invention is composed of a support frame 11 and a base 12. The base 12 is provided with a plurality of castors 14 fastened pivotally therewith. The support frame 11 is provided at the front end thereof with two flexible devices 13 which are fastened respectively at one end thereof with the base 12 such that the support frame 11 and the base 12 form therebetween a bevel. As the cradle 1 of the present invention is started electrically, the cradle 1 is caused to swing up and down by means of the flexible devices 13. The support frame 11 is provided at the rear end 111 thereof with a hook 62. The base 12 is provided at the rear end thereof with an actuating box 2 fastened therewith.

The actuating box 2 comprise a spindle 21 having at one end thereof a projection 211 provided axially with an inner threaded hole 212. The actuating box 2 further comprises therein at each of four corners thereof a bolt 23 having axially an inner threaded hole 231. The actuating box 2 still further comprises therein a locating column 22 contiguous to one of the four bolts 23 and longer than the spindle 21. The locating column 22 is provided axially with an inner threaded hole 221. The actuating box 2 is provided in the upper side thereof with a long hole 24, and in a lateral side thereof with a wire hole 25. The actuating box 2 still further comprises therein a motor 7 which is mounted on a fastening mount 72 and is provided with a worm rod 71 fastened therewith. The motor 7 is connected with an external power source via a wire 73 passing through the wire hole 25 of the actuating box 2.

The actuating box 2 further comprises therein a disk 3 having a toothed portion 31 located on the rim thereof. The disk 3 is provided with a cam 32 fastened therewith. The cam 32 has at the center thereof a through hole 33 greater in dimension than the projection 211 of the spindle 21. A swing arm 4 is located in the actuating box 2 such that the swing arm 4 is fastened by means of three screws 55 engaging respectively a through hole 41 of the swing arm 4 and the inner threaded hole 221 of the locating column 22, a through hole 41 of the swing arm 4 and an axial hole 521 of a rotor 52, an inner threaded hole 531 of a bolt 53, and a through hole 41 of the swing arm 4 and a center hole 511 of an eccentric wheel 51. The motor 7 is mounted on the fastening mount 72 such that the worm rod 71 is engaged with the toothed portion 31 of the disk 3. The actuating box 2 still further comprises an elastic cord 6 which is provided at a lower end thereof with an engaging ring 61 capable of engaging the groove 512 of the eccentric wheel 51 so as to enable the swing arm 4 to be located at a level higher than the cam 32. The rotor 52 is capable of moving along the arcuate periphery of the cam 31. The actuating box 2 is fastened with a face plate 8 having a plurality of through holes 81 receiving therein screws 55 engageable with the inner threaded holes 231 of the bolts 23.

The elastic cord 6 is provided at the upper end thereof with a plurality of engaging rings 61. The elastic cord 6 is put through the long hole 24 of the actuating box 2 such that one of the engaging rings 61 is engaged with the hook 62 of the support frame 11.

In operation, the worm rod 71 is actuated by the motor 7 to push the disk 3 forward, thereby resulting in the slow rotation of the cam 32 and in the progressive up-and-down motion of the eccentric wheel 51. When the rotor 53 moves to arrive at the protruded portion of the cam 32, the hook 62 is pulled downwards by the elastic cord 6 so as to cause the cradle 1 to swing downwards. When the rotor 53 moves to arrive at the recessed portion of the cam 32, the downward pressure exerting on the elastic cord 6 is caused to diminish gradually to enable the flexible devices 3 to pull the cradle 1 upwards. The downward and the upward motions of the cradle 1 as described above are brought about repeatedly.

The cradle 1 of the present invention is electrically operated and is therefore free from the magnetic interference. In addition, the elastic cord 6 of the cradle 1 of the present invention is provided with a plurality of engaging rings 61. As a result, any one of the engaging rings 61 may be chosen to engage with the hook 62 of the support frame 11 in accordance with the weight of an infant to be held in the cradle 1. Moreover, all transmission elements are kept securely in the actuating box 2 so as to prevent the infant from being hurt accidentally.

The embodiment of the present invention described above is to be regarded in all respects as being merely illustrative and not restrictive. Accordingly, the present invention may be embodied in other specific forms without deviating from the spirit thereof. The present invention is therefore to be limited only by the scopes of the following appended claim.

What is claimed is:

1. A cradle comprising:

a support frame for holding an infant, said support frame provided at one end thereof with two flexible devices and at another end thereof with a retaining hook; and a base fastened at one end thereof with said flexible devices of said support frame and provided with a plurality of castors fastened pivotally therewith, said base further provided at another end thereof with an actuating box fastened thereto and provided therein with an actuating mechanism for causing said support frame to swing up and down in a reciprocating manner, said actuating box having an elastic cord provided at one end thereof with a plurality of engaging rings engageable with said retaining hook of said support frame;

wherein said actuating mechanism comprising:

a motor mounted on a fastening mount secured to said actuating box, said motor having a worm rod;

a disk mounted on a spindle secured to said actuating box, said disk provided on a rim thereof with a toothed portion engageable with said worm rod of said motor, said disk further provided with a cam fastened therewith; and a swing arm provided with an eccentric wheel fastened pivotally therewith and a rotor fastened pivotally therewith, said eccentric wheel having a groove engageable with an engaging ring of a lower end of said elastic cord, said swing arm being fastened with said actuating box such that said rotor is caused to move along an arcuate rim of said cam.

2. The cradle as defined in claim 1, wherein said motor is driven by an external power source via a wire connecting said motor with said external power source.

3. The cradle as defined in claim 1, wherein said actuating box is provided with a through hole dimensioned to enable said elastic cord to pass therethrough.

4. The cradle as defined in claim 2, wherein said actuating box is provided with a through hole dimensioned to allow said wire to pass therethrough.

5. The cradle as defined in claim 1, wherein said worm rod of said motor is actuated by said motor to drive said disk to move so as to bring about a slow rotation of said cam and an up-and-down motion of said eccentric wheel.

6. The cradle as defined in claim 1, wherein said elastic cord is exerted on by a downward pulling force when said rotor is caused to move to arrive at a protruded portion of said cam; and wherein said elastic cord is relieved of said downward pulling force when said rotor is caused to move to arrive at a recessed portion of said cam.

* * * * *